US009016320B1

(12) United States Patent
Kelley

(10) Patent No.: US 9,016,320 B1
(45) Date of Patent: Apr. 28, 2015

(54) INTELLIGENT FLOW CONTROL VALVE

(75) Inventor: Anthony R Kelley, Somerville, AL (US)

(73) Assignee: The United States of America as Represented by the Administrator of the National Aeronautics and Space Administration, Washington, DC (US)

( * ) Notice: Subject to any disclaimer, the term of this patent is extended or adjusted under 35 U.S.C. 154(b) by 960 days.

(21) Appl. No.: 13/174,084

(22) Filed: Jun. 30, 2011

(51) Int. Cl.

| | |
|---|---|
| ***F16L 55/10*** | (2006.01) |
| ***G05D 7/01*** | (2006.01) |
| ***E21B 19/00*** | (2006.01) |
| ***E21B 33/12*** | (2006.01) |
| ***F16K 31/44*** | (2006.01) |
| ***E21B 33/128*** | (2006.01) |

(52) U.S. Cl.
CPC ..... *E21B 33/128* (2013.01)

(58) Field of Classification Search
CPC ..... E21B 33/134; E21B 33/136
USPC ..... 138/40, 41, 44–46, 89, 90; 166/86.1–87.1, 91.1, 97.1, 75.13, 386, 166/179, 192; 405/42; 135/20.3, 25.31, 135/25.33, 26, 27, 29, 31, 98
See application file for complete search history.

(56) References Cited

U.S. PATENT DOCUMENTS

| | | | | |
|---|---|---|---|---|
| 2,229,325 | A * | 1/1941 | Greene | 166/214 |
| 2,253,224 | A * | 8/1941 | Bleakley | 166/192 |
| 2,646,845 | A | 7/1953 | Schillinger | |
| 2,672,200 | A | 3/1954 | Patterson | |
| 2,710,065 | A | 6/1955 | Hamilton, Jr. | |
| 2,888,078 | A * | 5/1959 | Lebourg | 166/290 |
| 2,969,839 | A | 1/1961 | Greene | |
| 3,070,163 | A | 12/1962 | Colby, et. al. | |
| 3,070,346 | A * | 12/1962 | Kennedy | 251/266 |
| 3,079,997 | A | 3/1963 | Blydorp | |
| 3,114,422 | A * | 12/1963 | Solum et al. | 166/202 |
| 3,489,216 | A | 1/1970 | Armstrong, et.al. | |
| 4,576,042 | A * | 3/1986 | Johnson | 73/152.36 |
| 4,669,540 | A | 6/1987 | Luoma et al. | |
| 4,875,615 | A | 10/1989 | Savard | |
| 5,335,730 | A * | 8/1994 | Cotham, III | 166/374 |
| 6,098,664 | A * | 8/2000 | Savard et al. | 138/89 |
| 6,241,424 | B1 | 6/2001 | Bath et al. | |
| 6,454,001 | B1 | 9/2002 | Thompson et al. | |
| 6,543,536 | B2 * | 4/2003 | Dewey et al. | 166/255.2 |
| 2006/0254660 | A1 | 11/2006 | McIlwain | |
| 2010/0126714 | A1 | 5/2010 | Ostevik | |
| 2011/0000669 | A1 * | 1/2011 | Barlow et al. | 166/297 |
| 2011/0290471 | A1 * | 12/2011 | Cutts | 166/85.3 |

FOREIGN PATENT DOCUMENTS

| | | | |
|---|---|---|---|
| CA | 1209033 | A * | 8/1986 |

* cited by examiner

*Primary Examiner* — Patrick F Brinson
*Assistant Examiner* — Matthew Lembo
(74) *Attorney, Agent, or Firm* — Absolute Technology Law Group, LLC; James J. McGroary

(57) ABSTRACT

The present invention is an intelligent flow control valve which may be inserted into the flow coming out of a pipe and activated to provide a method to stop, measure, and meter flow coming from the open or possibly broken pipe. The intelligent flow control valve may be used to stop the flow while repairs are made. Once repairs have been made, the valve may be removed or used as a control valve to meter the amount of flow from inside the pipe. With the addition of instrumentation, the valve may also be used as a variable area flow meter and flow controller programmed based upon flowing conditions. With robotic additions, the valve may be configured to crawl into a desired pipe location, anchor itself, and activate flow control or metering remotely.

21 Claims, 11 Drawing Sheets

INTELLIGENT FLOW CONTROL VALVE

FEDERAL RESEARCH STATEMENT

The invention described herein was made by employees of the United States Government and may be manufactured and used by or for the Government of the United States of America for governmental purposes without the payment of any royalties thereon or therefor.

CROSS-REFERENCES TO RELATED APPLICATIONS

None.

FIELD OF INVENTION

The present invention relates to methods and apparatuses for stopping the flow of fluid and more particularly to an intelligent flow control valve.

TERMINOLOGY

As used herein, the term "anchor assembly" refers to one or more components used to hold and secure an intelligent flow control valve in position in a pipe.

As used herein, the term "expansion panel" refers to the pieces which make up the umbrella of an intelligent flow control valve.

As used herein, the term "scissor component" refers to a plurality of hinged brace components arranged symmetrically around a threaded component which enables the hinged brace components to be repositioned. For example, hinged brace components may be pushed away from the threaded component when the threaded component is turned one direction and pulled toward the threaded component when the threaded component is turned in the opposite direction.

As used herein, the term "throttle" means to increase or decrease the area of an umbrella to decrease or increase the pipe flow area, which controls flow.

As used herein, the term "umbrella" refers to an elongated component of a variable area control, component having a variable surface area which may be changed to increase or decrease the flow.

As used herein, the term "umbrella control lead screw" refers to a threaded component that is rotated to change the area of an umbrella to alter flow.

As used herein, the term "variable area control component" refers to the component of an intelligent flow control valve which is metered to increase or decrease the pipe flow area, changing the delta pressure across the device for different flow rates.

BACKGROUND OF THE INVENTION

A pipe plug is any type of physical barrier that effectively stops the flow of oil from an oil well or fluid from a pipe. Effective pipe-plugging methods and apparatuses are required in a variety of situations.

Many states regulate the plugging of abandoned well structures to confine oil, gas, and water in the strata in which they are found and prevent them from escaping into other strata and destroying wildlife and water and creating other environmental hazards. It is important in these situations to completely and permanently stop the flow.

When pipelines are damaged, it is necessary to quickly stop the uncontrolled flow, often without regard to the continuing viability of the pipeline. The Deepwater Horizon oil spill (commonly known as the "BP oil spill") was the largest oil spill in the history of the petroleum industry. An estimated 53,000 barrels per day (8,400 $m^3$/d) escaped from the well just before it was capped, amid an international outcry. Millions of television and Internet viewers watched black plumes of oils spilling into the ocean as the company attempted to inject "dead weight" in the form of heavy liquid and cement and other barriers into the top and bottom of the well.

Inserting a device into the escaping flow was difficult or impossible to control and the dead weight did not prevent blow out causing oil escape at other locations. In addition, due to extremely harsh environments (e.g., ocean floor), repairing these pipes is often very difficult.

Even more controversial than the escaping oil was the inability to monitor the flow of oil while repairs were being made.

Although the Deepwater Horizon oil spill was a well-publicized historic event, damage to pipelines occurs with some regularity and even predictability. Containing the BP spill was the predominant concern without regard to the future viability of the well. Many pipelines, however, must be repaired and placed back into use.

Dead weight plugging methods known in the art generally do not seal the pipes completely. In addition, these plugs cannot be removed once they are in place.

It is necessary to stop or meter the amount the flow during, and possibly after, the repair process. In addition, the plugging device must be capable of being opened or removed from the pipe once the repairs have been completed.

Various plugging methods and apparatuses are disclosed in the art (e.g., U.S. Pat. Nos. 2,646,845, 2,672,200, 2,710,065, 2,969,839, 3,070,163, 3,079,997, and 3,489,216). Invariably, these methods require placement of some type of material (e.g., heavy liquids, gravel, cementitious material, epoxy resin mixture, sealant, drilling mud) to form a solid barrier. These plugging methods and apparatuses are difficult or impossible to remove once the repair has been completed.

Typically, the pipe can be placed back into use only if a section of the pipe is cut out and the device removed. In addition, inserting a device that requires back-filling is complicated as constant pressure has to be applied while the back-filling material is drying.

The prior art also discloses attempts to create plugs which are mechanically adjustable to allow reuse of pipes after a repair. U.S. Pat. No. 6,241,424 (Bath '424) teaches a plug apparatus which includes a body shaft having an external surface and an internal cavity. A cup seal is mounted to the body shaft and engages an interior wall of the pipeline. The cup seal is roughly the size of the internal pipe. A cam is attached to the external surface of the body shaft and a slip assembly slides on the cam to engage a slip with the interior wall. A control mechanism controls the engagement and release of the slip from the interior wall. The plug taught by Bath '424 is not desirable because the fixed diameter of the cup seal does not allow for metered flow.

It is desirable to have a pipe plug which does not require back-filling.

It is desirable to have a pipe plug which may be easily removed from the pipe or which allows for flow through after repairs are made.

It is further desirable to have a pipe plug which allows for controlled and metered flow.

SUMMARY OF THE INVENTION

The present invention is an intelligent flow control valve comprised of an anchoring mechanism and a variable area control component. The variable area control component is comprised of a fixed frame; an internal longeron frame comprised of a plurality of tracks attached to the bottom of the fixed frame; a plurality of expansion panels; a plurality of alternating inner hinges and outer hinges which connect the expansion panels to form an umbrella; and a plurality of slide points along the inner hinges where the expansion panels slide along the tracks of*the internal longeron frame. To change the area of the expansion panels, an umbrella control lead screw is rotated in one direction to deploy the expansion panels and in the opposite direction to close the expansion panels.

DETAILED DESCRIPTION

Figure 1:
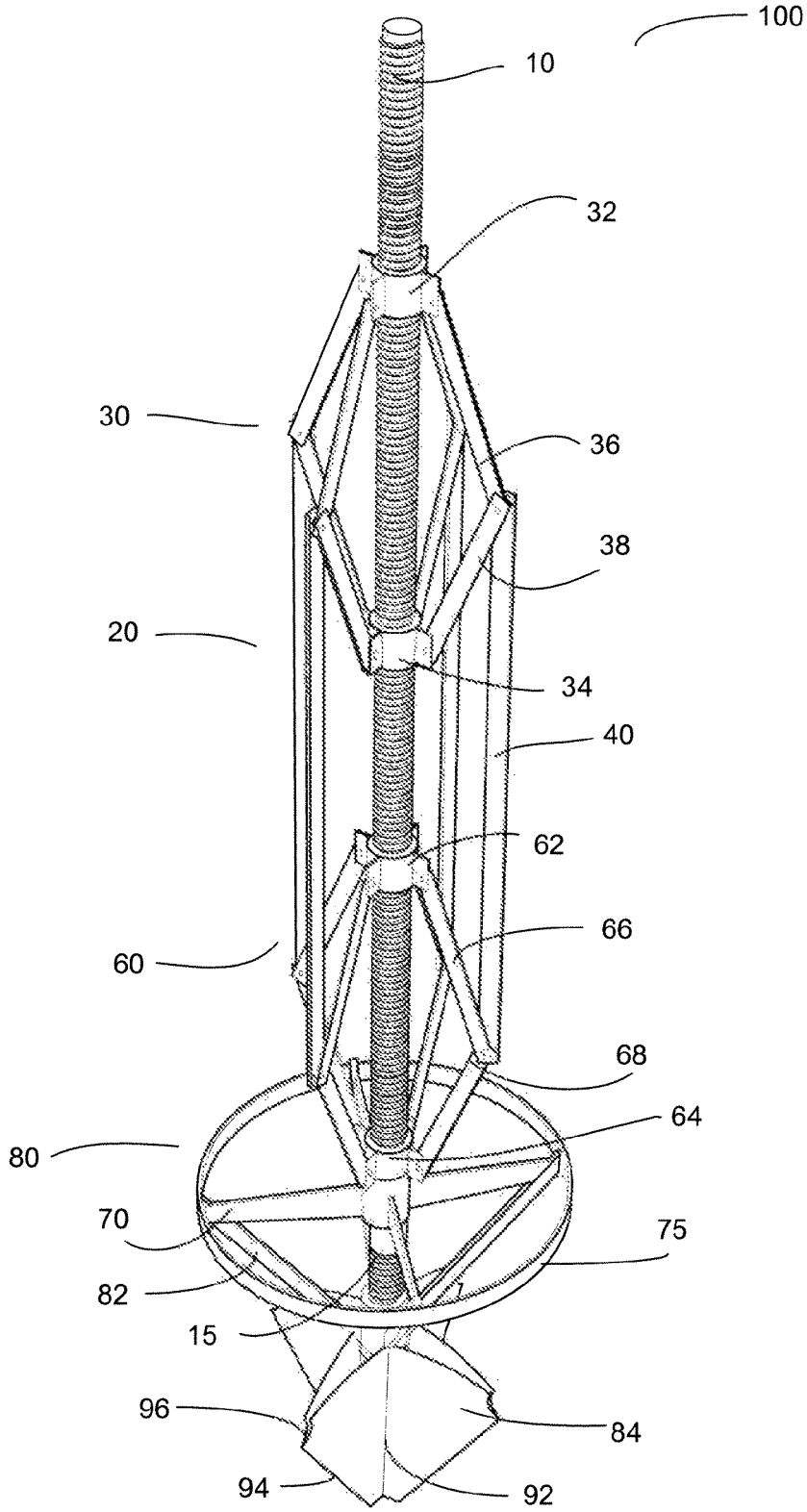
FIG. 1 illustrates a perspective view of an exemplary embodiment of an intelligent flow control valve with variable area control component closed.

For the purpose of promoting an understanding of the present invention, references are made in the text to exemplary embodiments of an intelligent flow control valve and variable area flow meter, only some of which are described herein. It should be understood that no limitations on the scope of the invention are intended by describing these exemplary embodiments. One of ordinary skill in the art will readily appreciate that alternate but functionally equivalent materials, components, and designs may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

It should be understood that the drawings are not necessarily to scale; instead, emphasis has been placed upon illustrating the principles of the invention. In addition, in the embodiments depicted herein, like reference numerals in the various drawings refer to identical or near identical structural elements.

Moreover, the terms "substantially" or "approximately" as used herein may be applied to modify any quantitative representation that could permissibly vary without resulting in a change in the basic function to which it is related.

FIG. 1 illustrates a perspective view of an exemplary embodiment of intelligent flow control valve 100. In the embodiment shown, intelligent flow control valve 100 is comprised of lead screw 10, umbrella control lead screw 15, frame 20, and variable area control component 80.

In the embodiment shown, frame 20 is comprised of a plurality of vertical arms 40 and anchor assemblies 30, 60. Vertical arms 40 provide a rigid framework for anchor assemblies 30, 60 and prevent rotation of anchor assemblies 30, 60 while intelligent flow control valve 100 is secured inside a pipe.

In the embodiment shown, anchor assemblies 30, 60 are scissor components comprised of moving collars 32, 62, rigid collars 34, 64, first set of braces 36, 66, and second set of braces 38, 68. Braces 36, 66 are hinged at one end to moving collar 32, 62, respectively, and at the other end to vertical arms 40. Braces 38, 68 are hinged at one end to rigid collar 34, 64, respectively, and at the other end to vertical arms 40. Braces 36 and braces 38 are secured to one end of said vertical arms 40 at a common pivot point and braces 66 and braces 68 are secured to the opposite end of vertical arms 40 at a common pivot point. The angle between braces 36 and braces 38 at the pivot point and between braces 66 and braces 68 at the pivot point increases or decreases as the distance between moving collar 32 and rigid collar 34 and moving collar 62 and rigid collar 64 changes.

Moving collars 32, 62 and rigid collars 34, 64 encircle lead screw 10, which is threaded. Rigid collars 34, 64 are fixed in position on lead screw 10 while moving collars 32, 62 move when lead screw 10 is turned. In an exemplary embodiment, lead screw 10 has both left-handed and right-handed threads, allowing moving collars 32, 62 to move toward rigid collars 34, 64 when lead screw 10 is rotated in one direction and away from rigid collars 34, 64 when lead screw 10 is rotated in the opposite direction. For example, moving collars 32, 62 and the portions of lead screw 10 around moving collars 32, 62 may have left-handed threads while rigid collars 34, 64 and the portions of lead screw 10 surrounding rigid collars 34, 64 may have right-handed threads.

When lead screw 10 is rotated so that moving collars 32, 62 move toward rigid collars 34, 64, the angle between braces 36 and braces 38 and the angle between braces 66 and braces 68 decreases and vertical members 40 are pushed away from lead screw 10 toward to the pipe wall to anchor frame 20 and intelligent flow control valve 100 inside the pipe.

To pull vertical members 40 and frame 20 off of the pipe wall, that is, to remove intelligent flow control valve 100 from inside the pipe, lead screw 10 is rotated in the opposite direction, causing moving collars 32, 62 to move away from rigid collars 34, 64. When moving collars 32, 62 are moved away from rigid collars 34, 64, the angle between braces 36 and braces 38 and the angle between braces 66 and braces 68 increases and vertical members 40 move closer to lead screw 10 and away from the pipe wall.

In the embodiment shown, frame 20 includes four vertical arms 40 and each set of braces 36, 38, 66, 68 has four braces. The vertical arms and braces are arranged around lead screw 10 so that intelligent flow control valve 100 is symmetrical, ensuring that the device self-centers when inserted into a pipe.

In the embodiment shown, variable area control component 80 is comprised of a fixed frame 70, ring 75, internal longeron frame 82, and a plurality of expansion panels 84. Fixed frame 70 and ring 75 add strength to variable area control component 80, allowing variable area control component 80 to withstand high-pressure flow and eliminating the need for back-filling. Internal longeron frame 82 flairs out expansion panels 84, creating a curved chamber to fit against the pipe wall and further strengthening variable area control component 80.

In the embodiment shown, fixed frame 70, ring 75, and internal longeron frame 82 are comprised of heavy steel and internal longeron frame 82 is coated with polytetrafluoroethylene; however, in various other embodiments, may be comprised of another materials and/or coatings. In various other embodiments, ring 75 may be omitted.

In the embodiment shown, variable area control component 80 is cone-shaped and includes eight expansion panels 84 and internal longeron frame 82 has four tracks. Expansion panels 84 are hinged together, creating a plurality of inner hinges 92 and outer hinges 94 when variable area control component 80 is closed or partially deployed.

Material is removed from the outer edge of expansion panels 84 where outer hinges 94 are positioned, creating clearance cut-outs 96. Without clearance cut-outs 96, the edges of expansion panels 84 on outer hinges 92 would protrude past ring 75, preventing ring 75 of variable area control component 80 from fitting against the pipe wall and/or preventing expansion panels 84 from opening and closing.

In various other embodiments, the number of expansion panels 84 and tracks of internal longeron frame 82 may vary. For example, variable area control component 80 may be comprised of sixteen expansion panels with an eight track internal longeron frame (i.e., factor of two). In various embodiments, the depth of variable area control component 80, the placement of inner hinges 92 and outer hinges 94 may also vary to change the folded area and shape of variable area control component 80.

To change the area of expansion panels 84, umbrella control lead screw 15, is rotated in one direction to deploy expansion panels 80 and in the opposite direction to close expansion panels 80. When umbrella control lead screw 15 is rotated to deploy expansion panels 84, fixed frame 70, ring 75, and internal longeron frame 82 slides downward along slide points 86 (see FIGS. 6 and 7), pushing out expansion panels 84. When variable area control component 80 is fully deployed, expansion panels 84 rest against the tracks of internal longeron frame 82.

To decrease the area of expansion panels 84, that is, to partially or completely close variable area control component 80, umbrella control lead screw 15 is rotated in the opposite direction, causing fixed frame 70, ring 75, and internal longeron frame 82 to slide away from expansion panels 84 along slide points 96, retracting expansion panels 84 to increase flow. Increasing flow reduces the pressure across the variable area control component and decreasing flow increases the pressure across the variable area control component.

In the embodiment shown, the tracks of internal longeron frame 82 are positioned at a 45 degree angle to the spokes of fixed frame 70 to maximize the strength of internal longeron frame 82, allowing variable area control component to withstand high pressure.

The dimensions of the components of variable area control component 80 and intelligent flow control valve 100 vary with the area of the pipe into which intelligent flow control valve 100 is to be inserted and whether it is used as a pipe plug, a flow meter, a flow controller, or combinations thereof. For example, for a pipe having a three inch diameter, intelligent flow control valve 100 has a length ranging from 12 to 18 inches with variable area control component 80 having a length of approximately 6 inches.

The design of variable area control component 80 allows the pipe open area to be changed, resulting in a variable area control and the ability to throttle, meter, and control gas or fluid flow. The pointed shape of variable area control component 80 allows for easy insertion into a flowing pipe with minimal resistance. The configuration of frame 20 and the cone shape of variable area control component 80 results in a strong device capable of with-standing high pressures and forces.

In addition, intelligent flow control valve 100 may further include instrumentation, allowing intelligent flow control valve 100 to be used as a differential head flow meter by adjusting the area of variable area control component 80 in response to different flowing conditions to enhance flow metering accuracy, control pressures losses, or control flows in a closed loop using feedback from the differential pressure across the device. In addition, using measured values from different flow areas enables estimation of fluid properties such as density and viscosity.

In various embodiments, intelligent flow control valve 100 may further include an optional robotic crawling mechanism for carrying intelligent flow control valve 100 deep into a pipe. In an exemplary embodiment, optional robotic crawling mechanism would include a motor for turning the lead screws.

In the embodiment shown, all components are designed for low drag in fluid.

Figure 2:
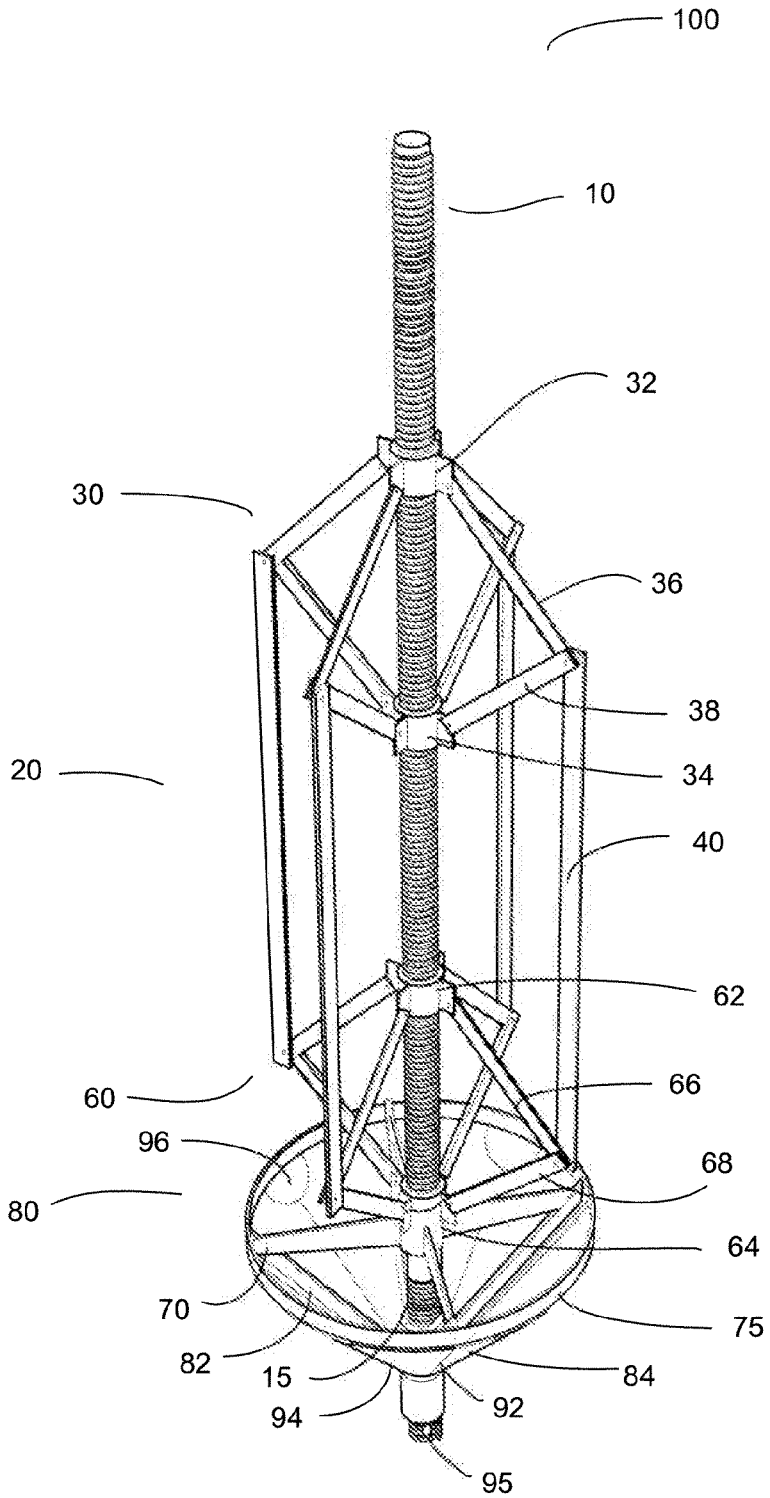
FIG. 2 illustrates a perspective view of an exemplary embodiment of an intelligent flow control valve with variable area control component fully deployed.

FIG. 2 illustrates a perspective view of an exemplary embodiment of intelligent flow control valve 100 with variable area control component 80 in the deployed position. In the embodiment shown, the tops of expansion panels 84 are positioned just below ring 75.

Also visible in FIG. 2 is pressure sensor port 95 for measuring the pressure of the flow across variable area control component 80.

Figure 3:
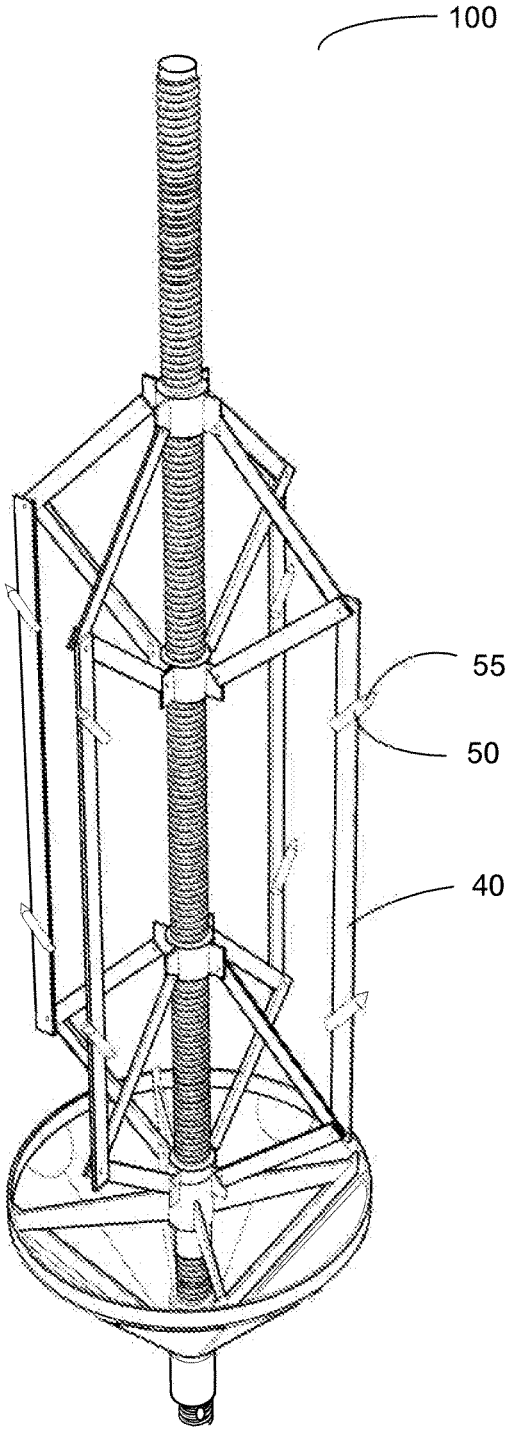
FIG. 3 illustrates a perspective view of an exemplary embodiment of an intelligent flow control valve with optional pyrotechnic anchoring mechanisms.

FIG. 3 illustrates a perspective view of an exemplary embodiment of intelligent flow control valve 100 with optional pyrotechnic anchoring mechanisms 50 attached to vertical arms 40.

Intelligent flow control valve 100 is inserted into the pipe so that anchoring components 50 are pointed in the direction of pipe flow. In the embodiment shown, pyrotechnic anchoring components 50 are spear devices with pyrotechnic charged spikes 55 which are fired to securely anchor intelligent flow control valve 100 inside a pipe.

In an exemplary embodiment, pyrotechnic anchoring components 50 include an ignition wire, a pyrotechnic charge, and a spring-loaded latch. Firing pyrotechnic anchoring components 50 drives spikes 55 into the pipe wall, permanently securing intelligent flow control valve 100 inside the pipe. In various other embodiments, spikes 55 may be replaced with another component, such as a barb.

In the embodiment shown, spikes 55 contain tungsten carbide or depleted uranium, which may aid in metal fusion when spikes 55 are driven into the pipe wall. When intelligent flow control valve 100 is anchored inside the pipe, variable area control component 80 can be opened in the pipe to throttle the oil flow.

In the embodiment shown, intelligent flow control valve 100 includes eight pyrotechnic anchoring components 50, two on each vertical arm 40; however, in various other embodiments, intelligent flow control valve 100 may include any number of pyrotechnic anchoring components. In various embodiments, one or more components scissor components, pyrotechnic charged spikes which are fired into the pipe wall, spring-loaded arms, external dead weight, permanent spikes pushed into the pipe wall via a lever or scissor motion, any other holding device, and combinations thereof may be used to brace and/or anchor intelligent flow control valve 100 in a pipe.

Figure 4:
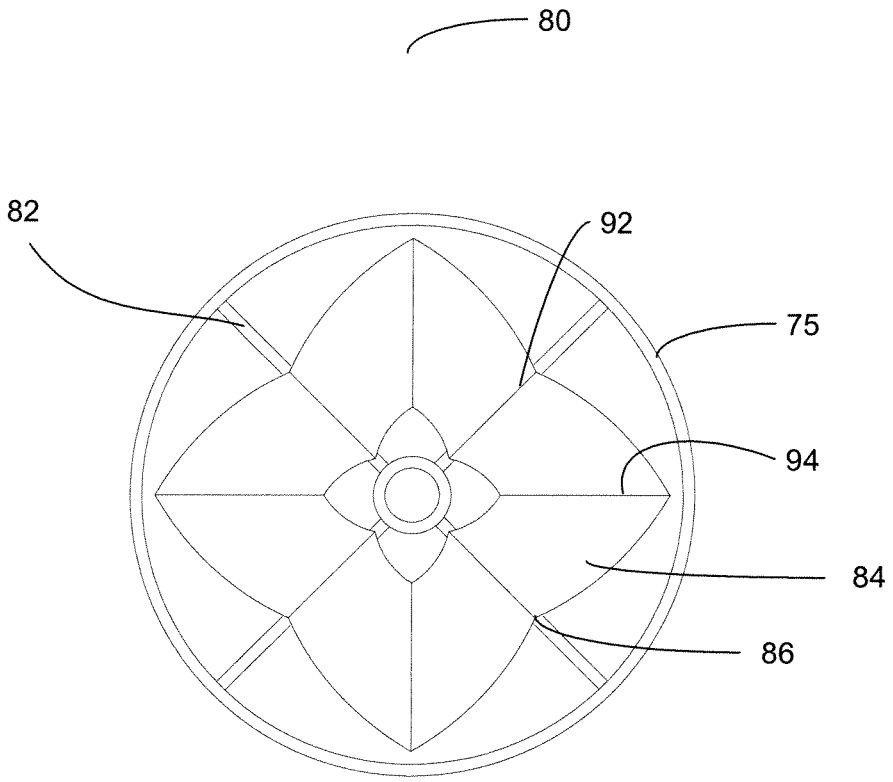
FIG. 4 illustrates a bottom view of an exemplary embodiment of a variable area control component closed.

FIG. 4 illustrates a bottom view of an exemplary embodiment of variable area control component 80 closed. When variable area control component 80 is closed, ring 75, internal longeron frame 82, expansion panels 84, inner hinges 92, outer hinges 94, and slide points 86 are visible from the bottom of variable area control component 80.

Figure 5:
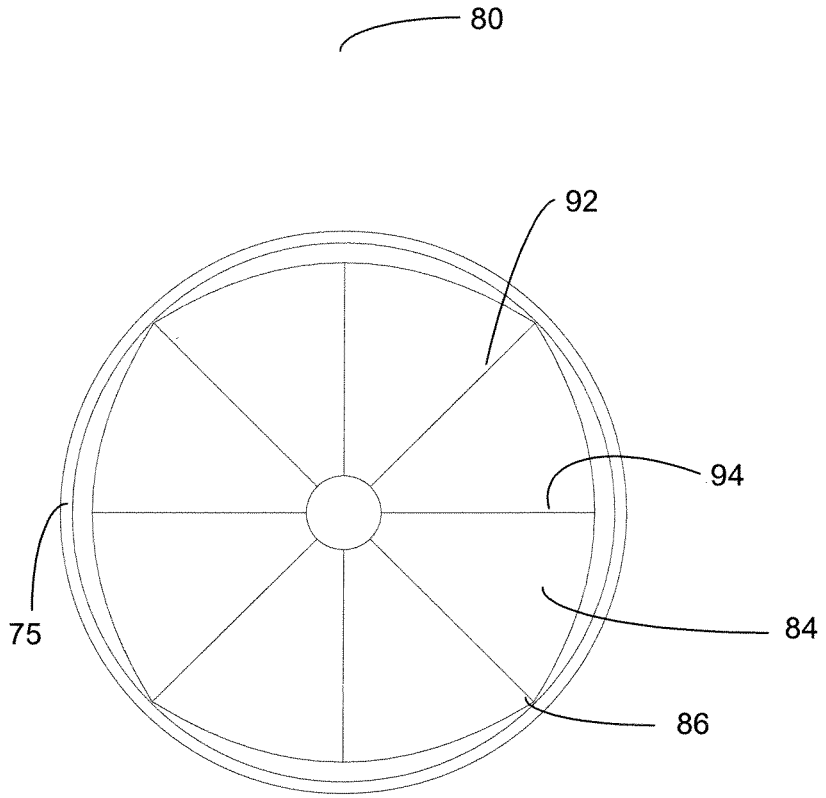
FIG. 5 illustrates a bottom view of an exemplary embodiment of a variable area control component fully deployed.

FIG. 5 illustrates a bottom view of an exemplary embodiment of variable area control component 80 fully deployed. When variable area control component 80 is fully deployed, expansion panels 84 are pushed out at both inner hinges 92 and outer hinges 94, forming a cone shape (see FIG. 7).

Figure 6:
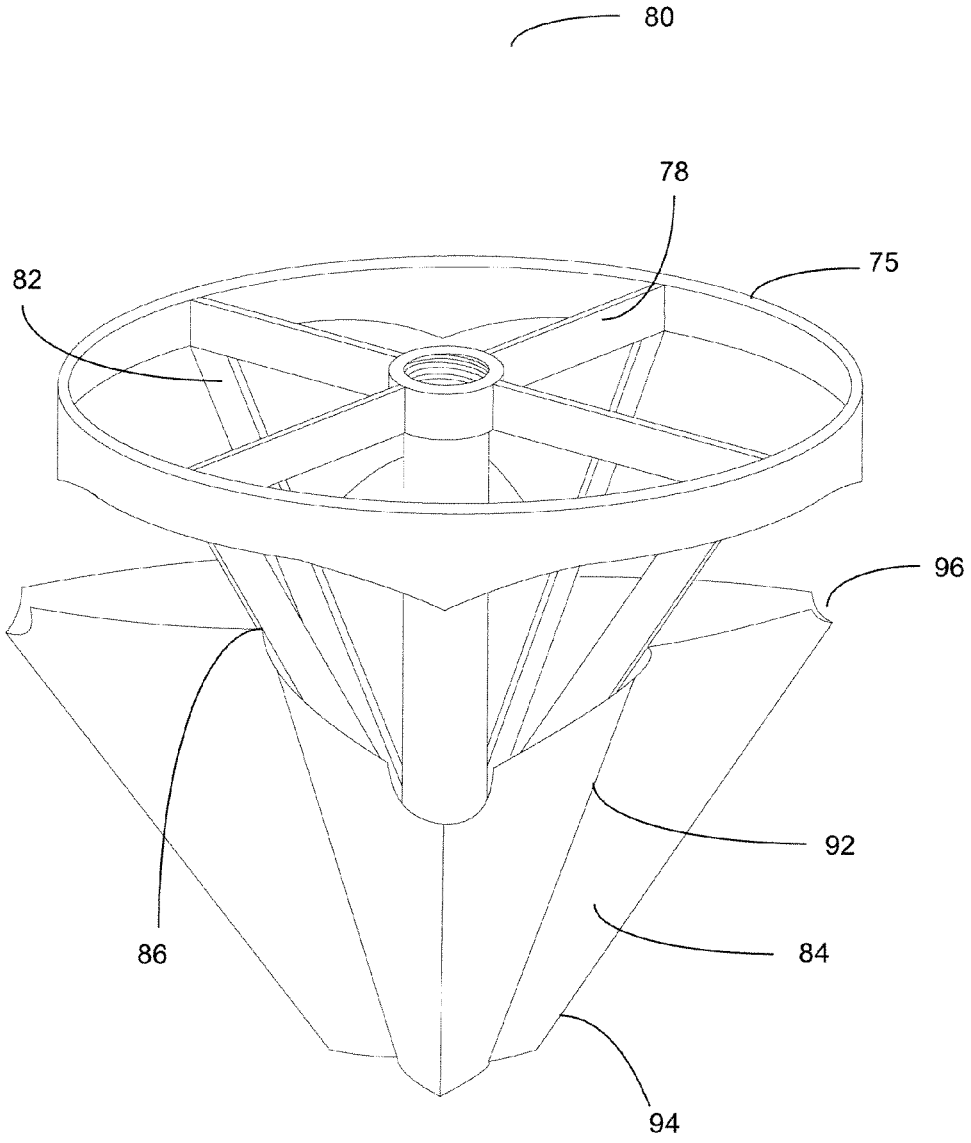
FIG. 6 illustrates a perspective view of an exemplary embodiment of a variable area control component closed.

FIG. 6 illustrates a perspective view of an exemplary embodiment of variable area control component 80 closed showing inner hinges 92, outer hinges 94, and slide points 86 where expansion panels 84 are attached to internal longeron frame 82.

Figure 7:
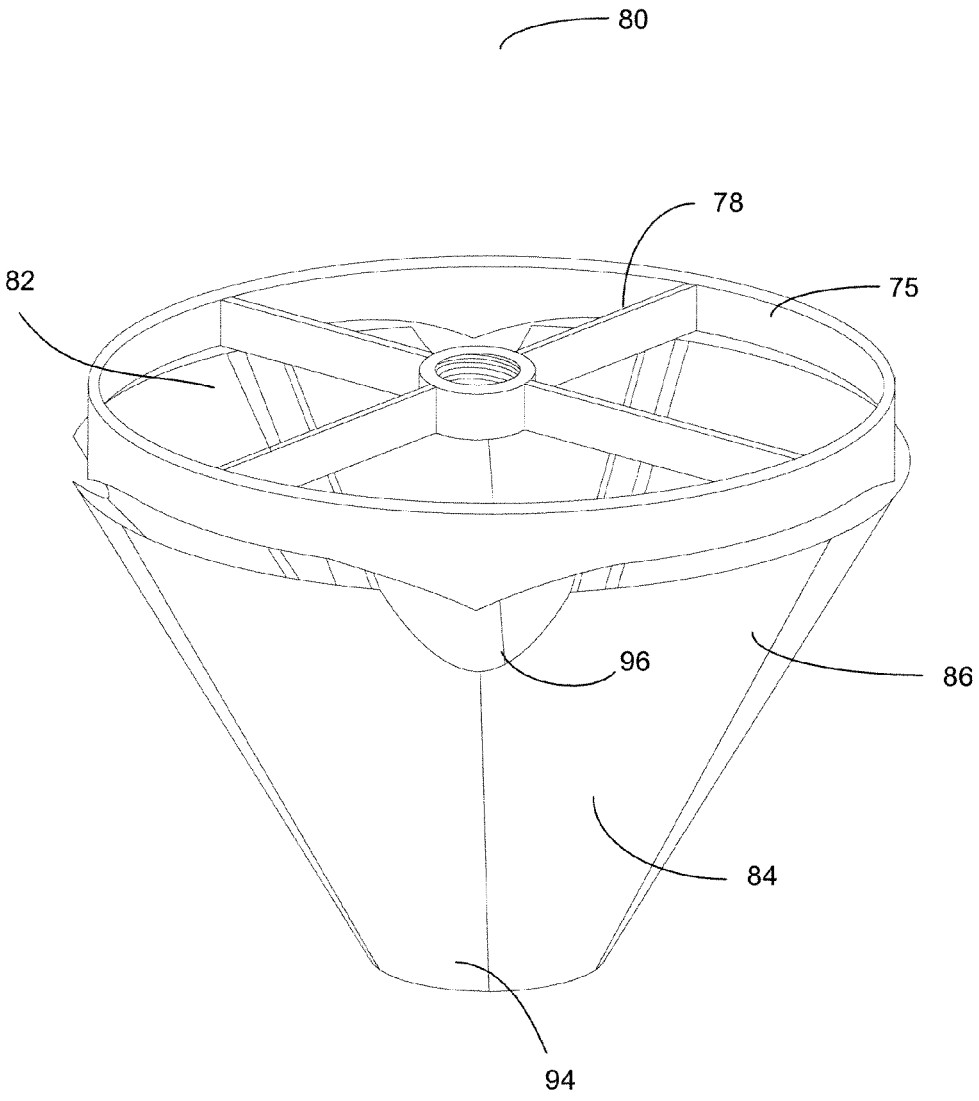
FIG. 7 illustrates a perspective view of an exemplary embodiment of a variable area control component fully deployed.

FIG. 7 illustrates a perspective view of an exemplary embodiment of variable area control component 80 fully deployed. When umbrella control lead screw 15 (not shown) is rotated to deploy expansion panels 84, fixed frame 70, ring 75, and internal longeron frame 82 slide downward along slide points 86, pushing out expansion panels 84.

Figure 8:
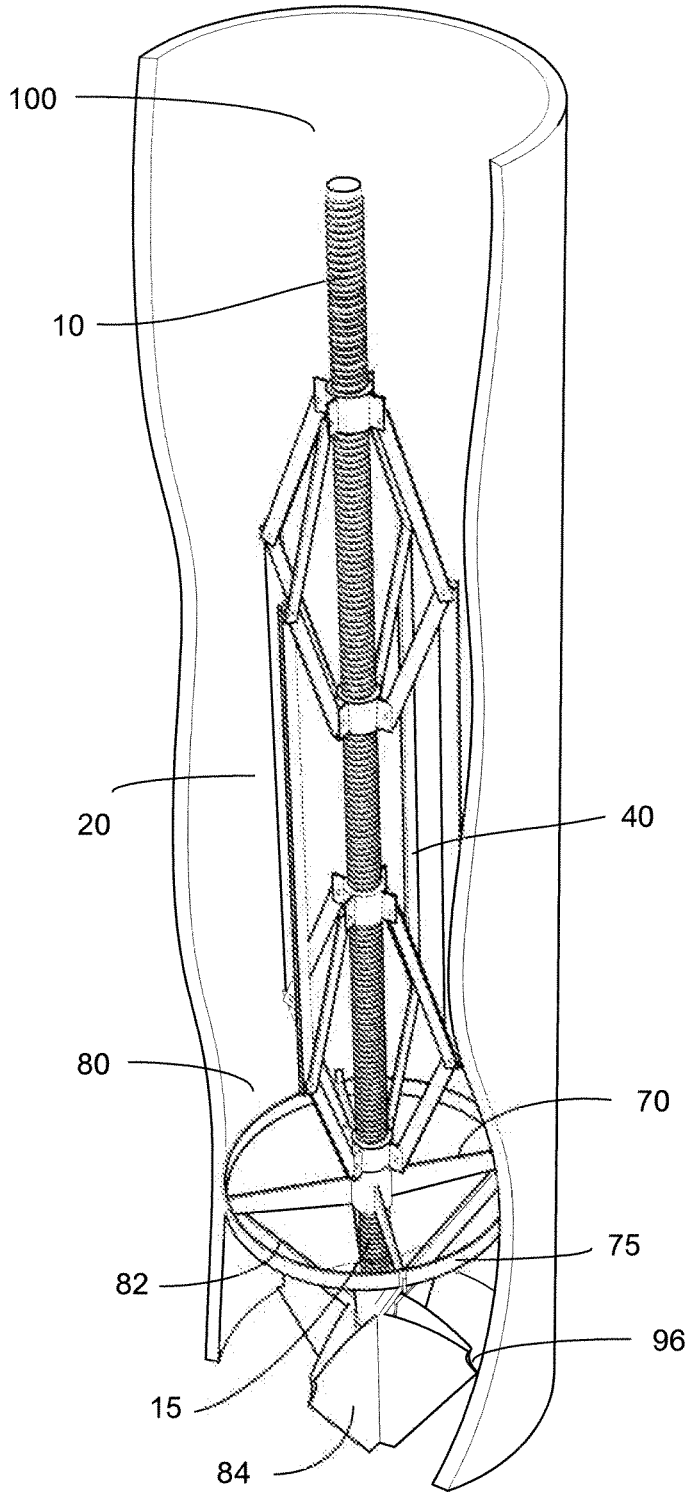
FIG. 8 illustrates an exemplary embodiment of an intelligent flow control valve inside a pipe with variable area control component closed.

FIG. 8 illustrates an exemplary embodiment of intelligent flow control valve 100 inside a pipe with variable area control component 80 in the closed position.

Intelligent flow control valve 100 is inserted into the open end of a flowing pipe with the variable area control component 80 inserted first. The shape of intelligent flow control valve 100 allows it be easily guided into the pipe. Frame 20 is expanded by rotating lead screw 10, causing scissor action which pushes vertical arms 40 outward against the pipe walls, securing intelligent flow control valve inside the pipe.

Optional pyrotechnic anchoring components 50 (not shown) would then be fired to permanently anchor frame 20 and intelligent flow control valve 100, if desired, to the pipe wall.

Once frame 20 is anchored, umbrella control lead screw 15 is rotated to activate variable area control component 80. Rotating umbrella control lead screw 15 forces expansion of variable area control component 80 by sliding fixed frame 70, ring 75, and internal longeron frame 82 downward, pushing out inner folds 92 of expansion panels 84. When variable area control component 80 is in its final position, expansion panels 84 rest against internal longeron frame 82. In an exemplary embodiment, when variable area control component 80 is fully deployed, it blocks approximately 95% to 98% of the flow.

In various embodiments, additional components, such as rubber gaskets may be added around umbrella control lead screw 15, ring 75, and/or any other components where leaking may occur.

Intelligent flow control valve 100 substantially reduces the volume of fluid leaked while relief wells are implemented or the pipe is repaired. In addition, intelligent flow control valve 100 may be removed or umbrella control lead screw 15 may be turned in the reverse direction to increase flow at any time, allowing intelligent flow control valve 100 to remain in the pipe.

In various embodiments, intelligent flow control valve 100 may further include a pivot point between variable area control component 80 and frame 20 which allows intelligent flow control valve 100 to be inserted through curves in the pipe. In still other embodiments, variable area control component 80 may be decoupled from frame 20 before intelligent flow control valve 100 is inserted into the pipe. Variable area control component 80 is then attached to frame 20 when frame 20 has been secured in the desired location in the pipe.

Figure 9:
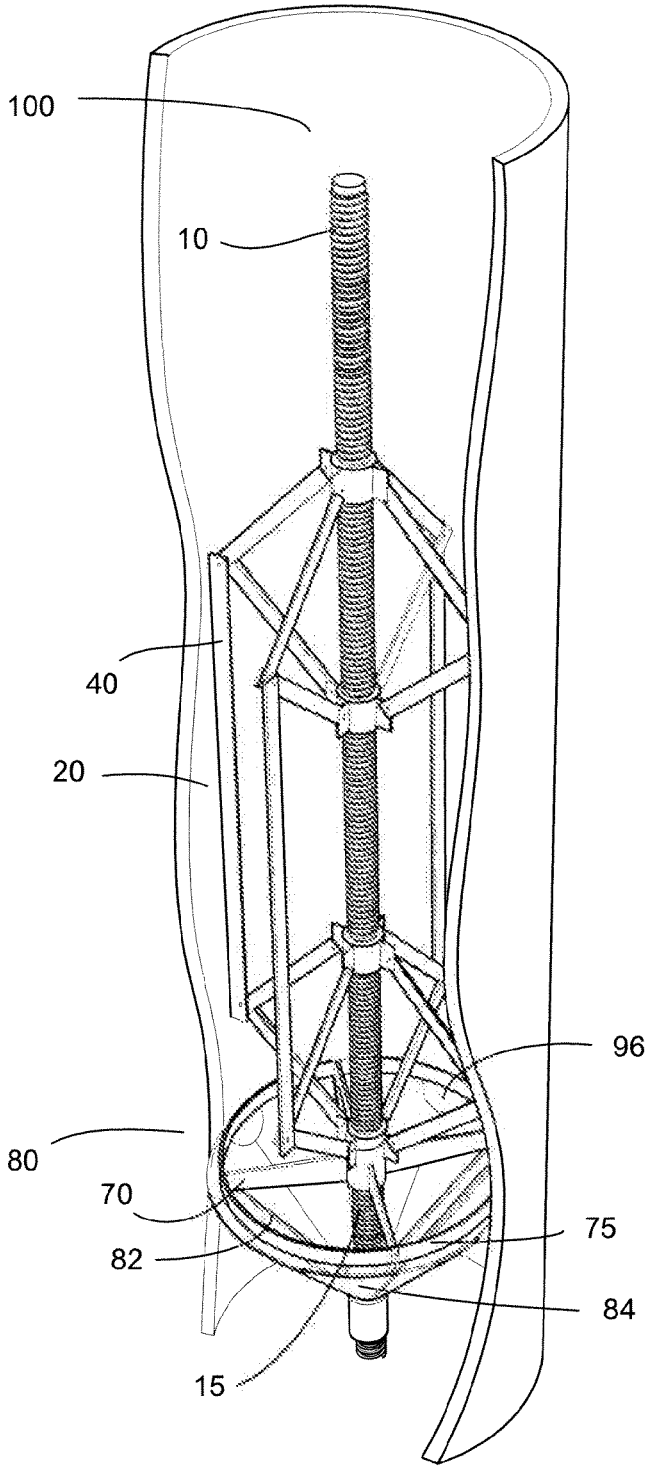
FIG. 9 illustrates an exemplary embodiment of an intelligent flow control valve inside a pipe with the frame secured against the pipe walls and variable area control component fully deployed.

FIG. 9 illustrates an exemplary embodiment of intelligent flow control valve 100 inside a pipe with frame 20 secured against the pipe walls and variable area control component 80 in the deployed position.

Figure 10:
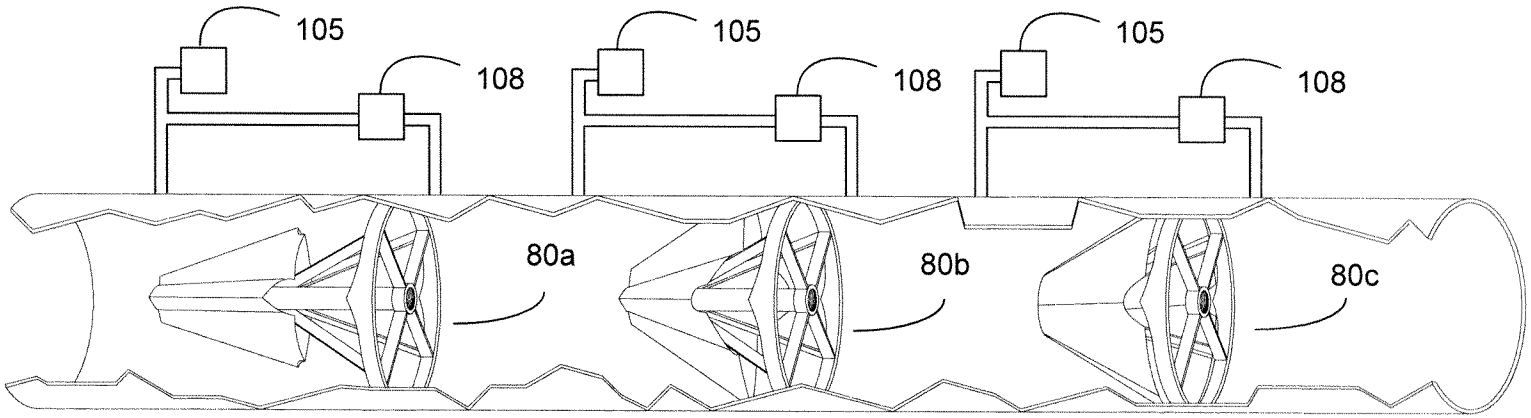
FIG. 10 illustrates an exemplary embodiment of a variable area control component used as a variable area flow meter.

FIG. 10 illustrates an exemplary embodiment of variable area control component 80 used as a variable area flow meter. In the embodiment, variable area control component 80*a* is closed, covering approximately 20% of the pipe area; variable area control component 80*b* is partially deploying, covering approximately 50% of the pipe area; and variable area control component 80*c* is fully deployed, covering approximately 95% of the pipe area.

In the embodiment shown, pressure sensors 105 and differential pressure sensors 108 are placed before and after the variable area control components 80*a*, 80*b*, 80*c*.

Figure 11:
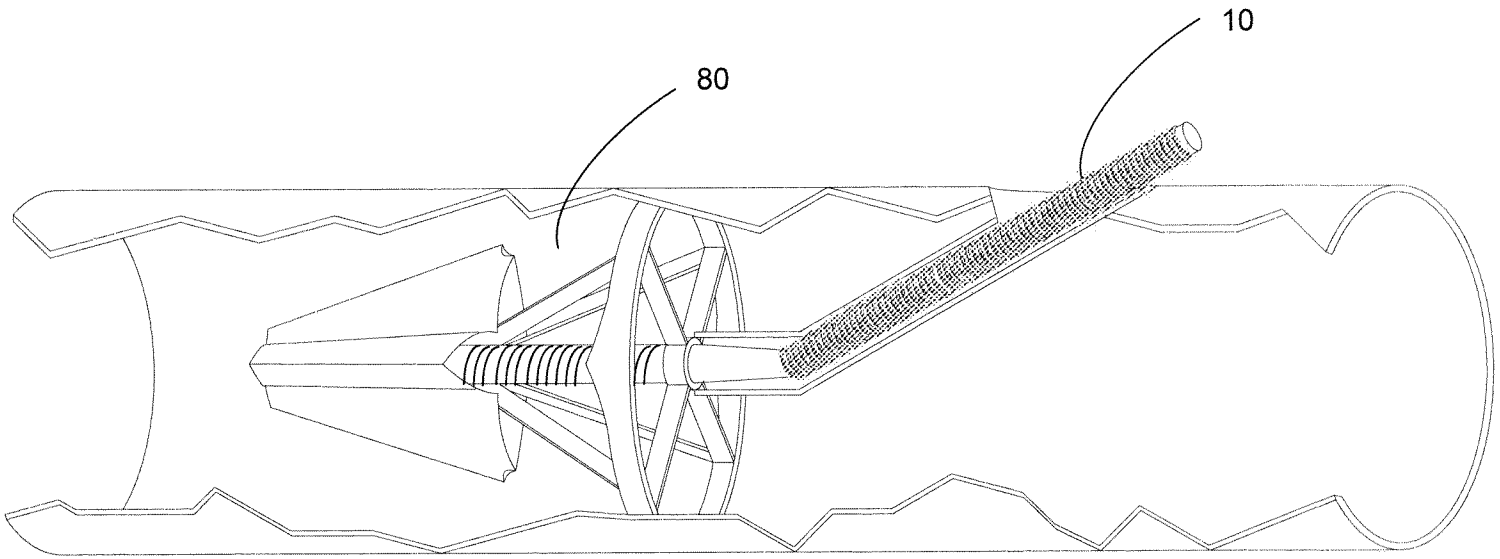
FIG. 11 illustrates an exemplary embodiment of an intelligent flow control valve for integrating with electronic flow calculation instrumentation.

FIG. 11 illustrates an exemplary embodiment of intelligent flow control valve 100 for integrating with electronic flow calculation instrumentation which allows intelligent flow control valve 100 to be used as a differential head flow meter by adjusting the area of variable area control component 80 in response to different flowing conditions to enhance flow metering accuracy, control pressures losses, or control flows in a closed loop using feedback from the differential pressure across the device. In addition, using measured values from different flow areas enables estimation of fluid properties such as density and viscosity.

Visible in the embodiment shown are variable area control component 80 and lead screw 10. In various other embodiments, variable area control component 80 may be actuated using other system, including, but not limited to hydraulic, pneumatic, flex muscle, etc.

What is claimed is:

1. An intelligent flow control valve apparatus comprised:
- an anchor assembly; and
- a conical variable area control component comprised of:
  - a fixed frame having a plurality of spokes, wherein said fixed frame is fixed relative to an internal longeron frame;
  - a ring surrounding and connecting said plurality of spokes;
  - said internal longeron frame comprised of a plurality of tracks attached to the bottom of said fixed frame, wherein each said plurality of tracks is attached to said fixed frame at one of said plurality of spokes;
  - a plurality of expansion panels;
  - a plurality of alternating inner hinges and outer hinges which connect said expansion panels to form an umbrella, wherein each of said plurality of expansion panels is connected to an inner hinge along a lateral edge and to an outer hinge along an opposite lateral edge; and
  - a plurality of slide points along said inner hinges where said expansion panels slide along said tracks of said internal longeron frame.

2. The apparatus of claim 1 wherein said anchor assembly is comprised of:
- a lead screw;
- a plurality of vertical arms;
- a first scissor component; and
- a second scissor component;

wherein said first scissor component and said second scissor component are each comprised of:

a moving collar which encircles said lead screw;

a rigid collar which encircles said lead screw;

a first set of braces hinged at a first end to said moving collar and at a second end to one of said plurality of vertical arms; and a second set of braces hinged at a first end to said rigid collar and at a second end to one of said plurality of vertical arms;

wherein said first set of braces and said second set of braces are attached to said plurality of vertical arms at a pivot point;

wherein when said lead screw is rotated in a first direction, said moving collar and said rigid collar move toward each other, decreasing the angle between said first set of braces and said second set of braces at said pivot point and pushing said plurality of vertical arms away from said lead screw;

wherein when said lead screw is rotated in a second direction, said moving collar and said rigid collar move away from each other, increasing the angle between said first set of braces and said second set of braces and moving said plurality of vertical arms toward said lead screw.

3. The apparatus of claim 2 wherein said first scissor component and said second scissor component are arranged symmetrically around said lead screw ensuring that said apparatus self-centers when inserted into a pipe.

4. The apparatus of claim 1 wherein said anchor assembly further includes a plurality of spikes to permanently secure said pipe plug apparatus in a pipe.

5. The apparatus of claim 4 wherein said spikes are pyrotechnically charged.

6. The apparatus of claim 5 wherein said pyrotechnically charged spikes contain depleted uranium.

7. The apparatus of claim 1 wherein said tracks of said internal longeron frame are attached to said fixed frame at a 45 degree angle.

8. The apparatus of claim 1 wherein when said conical variable area control component is closed, said expansion panels are folded inward at said inner hinges and outward at said outer hinges.

9. The apparatus of claim 1 wherein said conical variable area control component further includes a plurality of clearance cut-outs.

10. The apparatus of claim 1 wherein said conical variable area control component includes eight expansion panels and four of said internal longeron frame tracks.

11. The apparatus of claim 1 wherein said conical variable area control component is metered using sensors.

12. The apparatus of claim 11 wherein said sensors are located on said conical variable area control component.

13. The apparatus of claim 11 wherein data is sent to a remote apparatus which processes said data.

14. The apparatus of claim 13 wherein said remote apparatus identifies when said data meets predefined parameters and initiates an alert.

15. The apparatus of claim 1 wherein said conical variable area control component is controlled by a remote control device which changes the surface area of said conical variable area control component.

16. The apparatus of claim 15 wherein said remote control device is actuated by data.

17. The apparatus of claim 16 wherein said remote control device is actuated when said data meets predefined parameters.

18. A method for securing an intelligent flow control valve apparatus into a pipe comprised of the steps of:

guiding said intelligent flow control valve apparatus into the open end of a flowing pipe;

securing said apparatus inside said pipe by actuating an anchor assembly by actuating a first mechanical actuator; and actuating a variable area control component by actuating a second mechanical actuator to change a flow area of said pipe, wherein said first mechanical actuator is separately actuable from said second mechanical actuator, wherein said second mechanical actuator is connected to a fixed frame having a plurality of spokes, wherein said fixed frame is fixed relative to an internal longeron frame, wherein said step of changing a variable area control component is performed separately and independently of securing said apparatus inside said pipe.

19. The method of claim 18 which further includes the step of metering said variable area control component to change the amount of flow.

20. The method of claim 18 wherein said variable area control component is actuated by rotating an umbrella control lead screw in a first direction to slide said fixed frame and said internal longeron frame into a plurality of expansion panels along a plurality of tracks to push out said expansion panels to decrease flow.

21. The method of claim 18 wherein said surface area variable area control component is actuated by rotating an umbrella control lead screw in a second direction to slide said fixed frame and said internal longeron frame out of a plurality of expansion panels along a plurality of tracks to pull in said expansion panels to increase flow.

* * * * *